US005215310A

United States Patent [19]

Allbright

[11] Patent Number: 5,215,310

[45] Date of Patent: Jun. 1, 1993

[54] VOLLEYBALL NET SUPPORT AND TENSIONING SYSTEM

[76] Inventor: Edwin T. Allbright, 3130 Lowell Blvd., Denver, Colo. 80211

[21] Appl. No.: 824,066

[22] Filed: Jan. 22, 1992

[51] Int. Cl.[5] ..... A63B 67/00; A63B 61/04

[52] U.S. Cl. ..... 273/411; 273/29 B; 273/29 BC

[58] Field of Search ..... 273/411, 29 R, 29 A, 273/29 B, 29 BA, 29 BB, 29 BC, 29 BD, 29 BE, 29 BF, 29 BG

[56] References Cited

U.S. PATENT DOCUMENTS

| | | | |
|---|---|---|---|
| 2,638,346 | 5/1950 | Stapleton . | |
| 3,065,964 | 11/1962 | Barnes | 273/29 BB |
| 3,940,139 | 2/1976 | Barnes . | |
| 4,153,247 | 5/1979 | Burns . | |
| 4,830,382 | 5/1989 | Wheeler . | |
| 4,968,042 | 11/1990 | Stewart | 273/411 |
| 4,973,059 | 11/1990 | Stewart . | |

OTHER PUBLICATIONS

"The Kil-Kourt-A Portable Outdoor Volleyball Court System" brochure by AA Sports, Inc., 1984.

*Primary Examiner*—V. Millin
*Assistant Examiner*—Raleigh W. Chiu
*Attorney, Agent, or Firm*—Dorr, Carson, Sloan & Peterson

[57] ABSTRACT

A tensioning and support system for a sports net assembly uses a compound pulley arrangement attached to one of the vertical supports to simultaneously adjust the tension placed on both the upper and lower net cables. In one embodiment, each support has a standard extending upward from the ground, an upper elongated member, and a clamp for adjustably securing the upper elongated member to the upper portion of the standard to allow height adjustment of the net. A scale mounted between the upper end of the standard and the elongated member at approximately eye-height permits accurate measurement of the height of the net. Optionally, a clam cleat or other one-way cleat can be used to secure the free end of the pull cord extending from the pulley after the desired tension has been applied to the net cables.

17 Claims, 4 Drawing Sheets

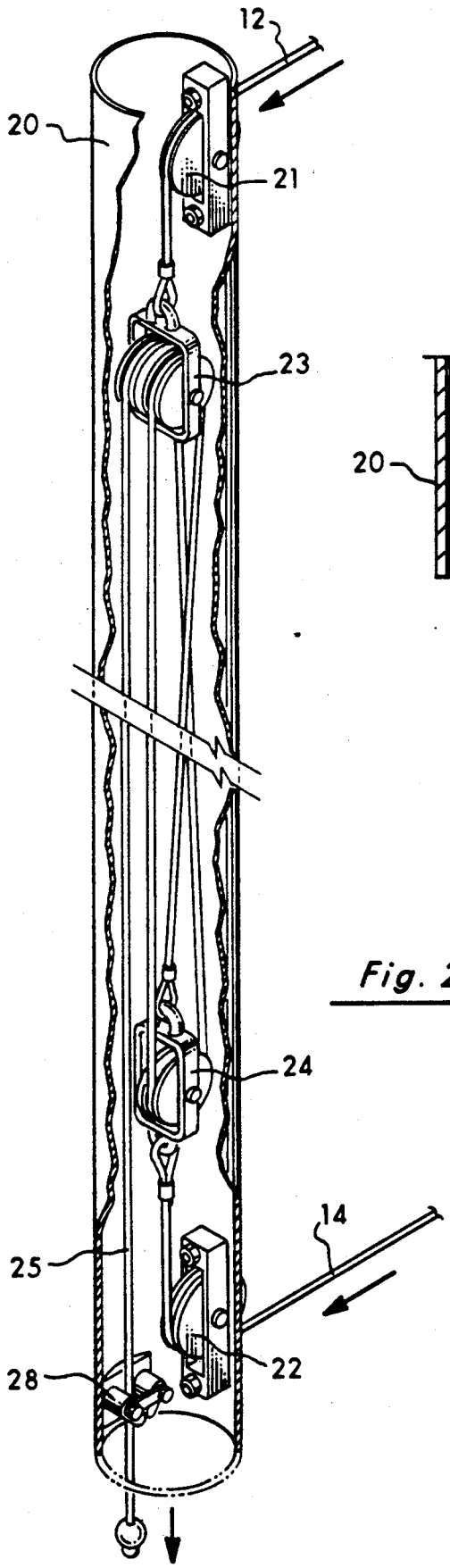
Fig. 2
Fig. 3
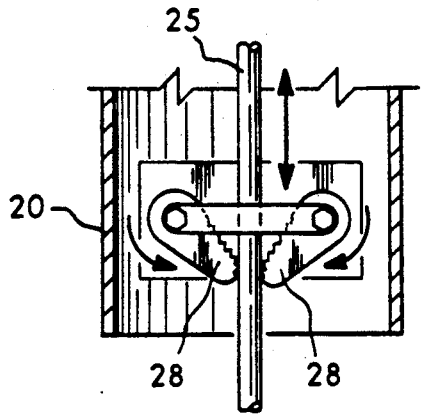

VOLLEYBALL NET SUPPORT AND TENSIONING SYSTEM

BACKGROUND OF THE INVENTION

1. Field of the Invention

The present invention relates generally to the field of volleyball nets. More specifically, the present invention discloses a support and tensioning system for volleyball nets that allows easy and accurate adjustment to the height of the net, and also allows simultaneous adjustment of the tension placed on the net cables with greater tension being placed on the upper net cable than on the lower net cable.

2. Statement of the Problem

A number of related problems have been recognized in association with proper support and tensioning of volleyball nets. First, it is important to be able to easily adjust and accurately set the height of the net. For example, regulations set different net heights for men's and women's volleyball games. In a tournament, it is advantageous to be able to quickly and accurately adjust the net for the appropriate height for each competition. Second, appropriate tension must be placed on the net between the standards. Ideally, greater tension should be placed on the upper net cable than on the lower net cable, since the upper cable must support the net without sagging and also withstand contact with the ball and the players. In contrast, the lower net cable requires only enough tension to bring the ball out of the net if the volleyball strikes the lower portion of the net.

A number of devices have been invented in the past relating to tensioning and height adjustment for volleyball nets, including the following:

| Inventor | Pat. No. | Issue Date |
|---|---|---|
| Stewart | 4,973,059 | Nov. 27, 1990 |
| Wheeler | 4,830,382 | May 16, 1989 |
| Burns | 4,153,247 | May 8, 1979 |
| Barnes | 3,940,139 | Feb. 24, 1976 |
| Stapleton | 2,638,346 | May 12, 1953 |

"The Kil-Kourt—A Portable Outdoor Volleyball Court System" brochure by AA Sports, Inc., 3544 North Southport Avenue, Chicago, Ill. 60657 (1984).

Stewart discloses a volleyball net adjuster using an arrangement of pulleys and a single winch to tighten both the upper and lower net cables in unison with equal force. A slidable mount is used to adjust the height of the net with respect to the standards.

Wheeler discloses a portable volleyball net support system. One end of the upper net cable is directed downwardly along the standard through an eye bolt. The free end of the cable is secured by a one-way cleat attached to the standard.

Burns discloses a ratchet mechanism for applying equal tension to the upper and lower cables of a game net, as best shown in FIG. 4 of this patent.

Barnes and Stapleton disclose volleyball net assemblies using a winch to simultaneously tension both the upper and lower cables of the net.

The 1984 brochure by AA Sports, Inc., discloses a volleyball net tensioning system in which a compound pulley is used to adjust the tension placed on the upper cable of the net. Further detail is provided in FIG. 4. A clam cleat 128 positioned above the upper pulley 123 is used to secure the upper net cable 112 after appropriate tension has been applied. Note that the clam cleat 128 secures the upper net cable 112, rather than the pull rope 125 extending around the pulleys 123 and 124. This means that the clam cleat 128 is subject to the entire tensioning force placed on the upper net cable 112, rather than the fractional force experienced by the pull rope 125. The lower pulley 124 is attached to the standard 130. The lower cable of the net is separately tensioned by hand and then secured by means of a second cleat.

3. Solution to the Problem

None of the prior art references uncovered in the search show a support and tensioning system for volleyball nets that uses a compound pulley arrangement to simultaneously apply tension to both the net cables, with a greater tension being applied to the upper cable than to the lower cable. In addition, this tensioning system can be mounted to an elongated member clamped to the upper end of the standard to allow easy and accurate adjustment to the height of the net.

SUMMARY OF THE INVENTION

This invention provides a tensioning and support system for a sports net assembly using a compound pulley arrangement attached to one of the vertical supports to simultaneously adjust the tension placed on both the upper and lower net cables. In one embodiment, each support has a standard extending upward from the ground, an upper elongated member, and a clamp for adjustably securing the upper elongated member to the upper portion of the standard to allow height adjustment of the net. A scale mounted between the upper end of the standard and the elongated member at approximately eye-height permits accurate measurement of the height of the net. Optionally, a clam cleat or other one-way cleat can be used to secure the free end of the pull cord extending from the pulley after the desired tension has been applied to the net cables.

A primary object of the present invention is to provide a means for simultaneously tensioning both cables of a volleyball net, with greater tension being applied to the upper cable than to the lower cable.

Another object of the present invention is to also provide a means for easily and accurately adjusting the height of the net.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 2 is a side perspective view corresponding to FIG. 1. Again, a portion of the support structure has been cut away to reveal the tensioning assembly.

FIG. 3 is a detail front view of the clam cleat used to anchor the pull cord.

DETAILED DESCRIPTION OF THE INVENTION

Figure 1:
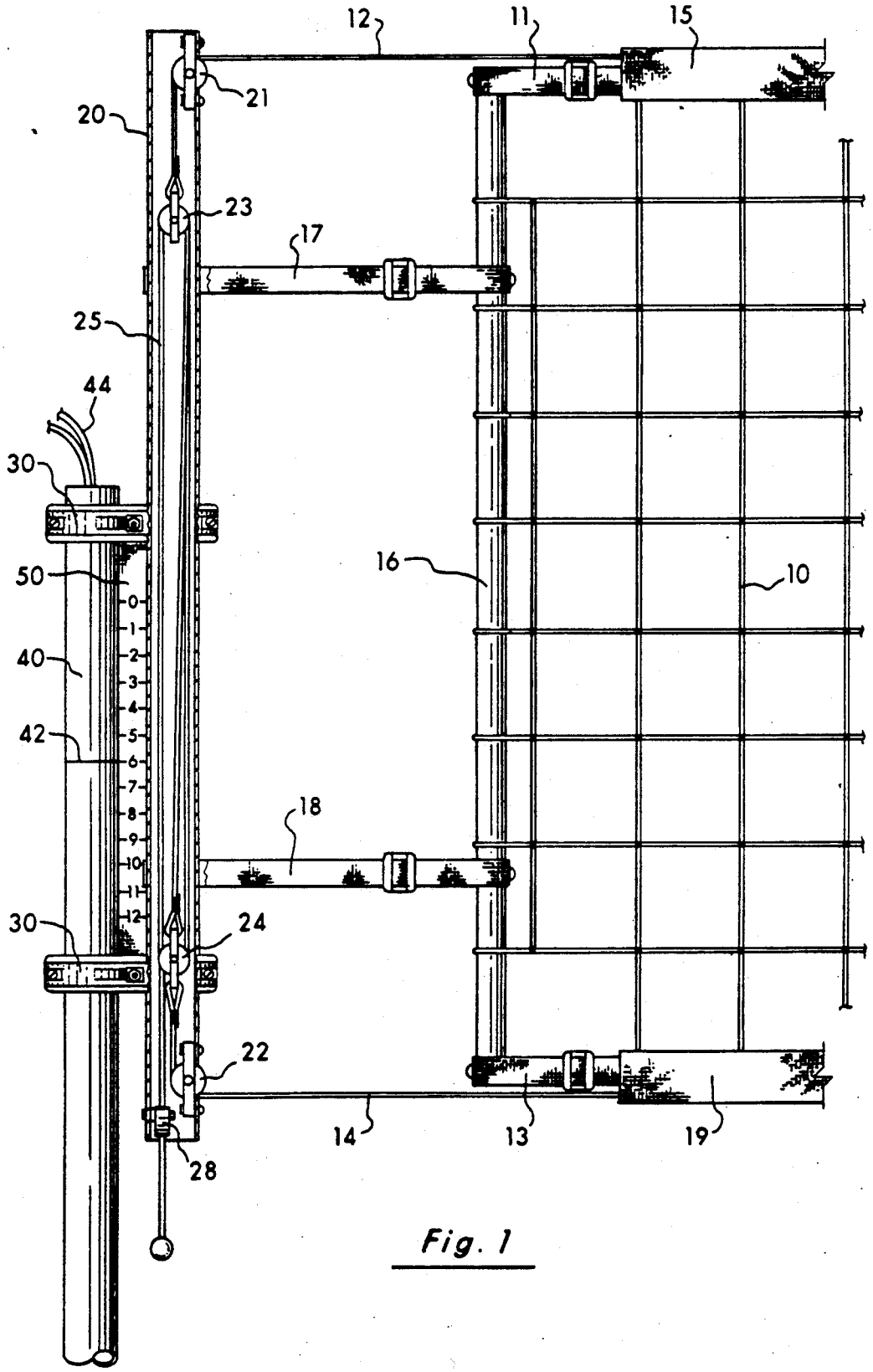
FIG. 1 is a front view of one end of the volleyball net assembly with a portion of the support structure cut away to reveal the tensioning assembly within.
Figure 4:
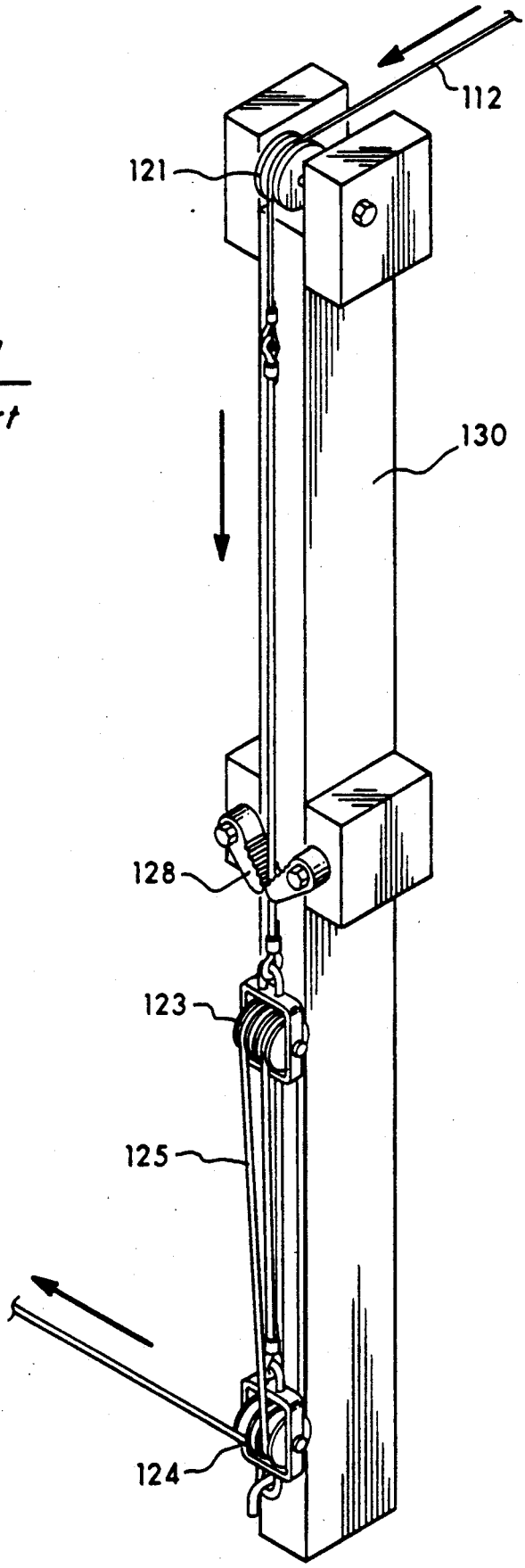
Fig. 4 Prior Art
FIG. 4 is a side perspective view of the prior art "Kil-Kourt" volleyball net tensioning assembly previously marketed by AA Sports, Inc., of Chicago, Ill., as previously discussed.

Turning to FIG. 1, a front view of one end of the net assembly is shown. The volleyball net 10 has an upper cable 12 extends along the upper edge of the net and a lower cable 14 extends along its bottom edge. Both the upper cable 12 and the lower cable 14 extend outward beyond the lateral edges of the net 10, as shown in FIG. 1, for suspending the net 10.

In the preferred embodiment, an upper binding 15 running along at least a portion of the upper edge of the net 10 is used to attach the upper cable 12 to the net 10. Similarly, a lower binding 19 running along the lower edge of the net is used to attach the lower cable 14. A stretcher bar 16 runs along the lateral edge of the net 10 for further support and to provide lateral tension to the net 10. A number of tightening straps 17, 18 are used to secure the stretcher bar 16 to the vertical support. Two additional tightening straps 11 and 13 can be used to maintain appropriate tension on the bindings 15 and 19, respectively, and the upper and lower edges of the net 10.

Two vertical supports are employed to support both lateral ends of the net 10. These vertical supports can be simple, one-piece standards mounted in the ground a predetermined distance apart from one another. However, in the embodiment shown in the drawings, the vertical supports have a multi-piece construction allowing adjustment of the height of the net 10. Each vertical support has a lower segment or standard 40 extending vertically upward from the ground. Additional support can be provided by means of a number of guy lines 44 running from the top of the standard 40 to stakes in the ground. The upper segment 20 of the support is attached in a substantially vertical orientation to the standard by a number of clamps shown in greater detail in FIGS. 5 and 6. This upper segment 20 can be virtually any type of elongated member. However, in the embodiment shown in the drawings, the upper segment 20 has a tubular shape suitable for housing the remainder of the tensioning system. This upper segment 20 is also known as the super stretcher bar.

As shown in FIGS. 1 and 2, the upper cable 12 and lower cable 14 of the net 10 extend over guide wheels 21 and 22, respectively, attached to the super stretcher bar 20. The upper guide wheel 21 directs the upper cable 12 downward along a portion of the length of the super stretcher bar 20, while the lower guide wheel 22 directs the lower cable 14 upward along the super stretcher bar 20. In the preferred embodiment, the upper and lower guide wheels 21 and 22 also serve to guide the net cables 12 and 14 into the interior of the tubular super stretcher bar 20. Alternatively, any of a variety of eyelets, tracks, eye bolts, or other types of guides could be used in place of the guide wheels 21 and 22 to direct the upper and lower cables 12 and 14.

A compound pulley arrangement is located between the upper guide wheel 21 and the lower guide wheel 22. The upper cable 12 is secured to the upper pulley 23 and the lower cable 14 is secured to the lower pulley 24 as depicted in FIGS. 1 and 2. A pull cord 25 is routed about the sheaves of the upper pulley 23 and lower pulley 24 in the conventional manner to create a compound pulley. The tensile force applied to the free end of the pull cord 25 is multiplied by the compound pulley arrangement and accordingly determines the tension placed on the upper cable 12 and the lower cable 14 of the net 10. It should be noted that tension is simultaneously applied by the compound pulley to both the upper cable 12 and the lower cable 14. However, the tension applied to the net cables 12 and 14 is not equal due to the number of pulley sheaves and the manner in which the pull cord is routed about the sheaves of the upper and lower pulleys 23 and 24. As shown most clearly in FIG. 2, three legs of the pull cord 25 extend from the lower pulley 24, while four legs of the pull cord extend from the upper pulley 23. For example, assuming the user exerts a tensile force of 10 pounds on the free end of the pull cord 25, the compound pulley arrangement will result in a force of 40 pounds on the upper pulley 23 and a force of 30 pounds on the lower pulley 24. Thus, the compound pulley arrangement depicted in FIG. 2 will always result in a ratio of forces of 1:4:3 between the free end of the pull cord 25, the upper pulley 23, and the lower pulley 24, respectively. The number of sheaves on the upper and lower pulleys 23 and 24 can be selected to result in a desired mechanical advantage for the compound pulley and the desired ratio of tension between the upper and lower net cables 12 and 14.

In the preferred embodiment, the compound pulley arrangement is housed within the interior of the tubular super stretcher bar 20 between the upper guide wheel 21 and the lower guide wheel 22 as shown in FIGS. 1 and 2. This helps to minimize exposure to dirt or sand. Any dirt or sand entering the interior of the super stretcher bar 20 will tend to fall out of the bottom opening shown in FIG. 1. The tubular super stretcher bar 20 also protects the tensioning assembly from damage that might otherwise result from blows or rough handling. Finally, the tubular super stretcher bar 20 increases safety by covering protrusions i associated with the pulleys that might otherwise cause injuries on contact, and by substantially eliminating the possibility that fingers or hands could become caught in the compound pulley arrangement.

After the desired tension has been placed on the net cables, the free end of the pull cord 25 is secured by a clam cleat 28 or other one-way cleat mounted on the super stretcher bar 20. One example of a clam cleat 28 is shown in greater detail in FIG. 3. The clam cleat allows the free end of the pull cord 25 to be freely drawn through the clam cleat in a direction tending to tighten the upper and lower cable 12 and 14 (i.e. downward), but tightly grips the pull cord 25 when the tensile force is released to prevent retraction of the pull cord 25 through the clam cleat 28. In the preferred embodiment, the clam cleat is housed in the interior of the tubular super L stretcher bar 20 below the compound pulley arrangement. The end of the pull cord 25 extends a short distance out of the bottom of the super stretcher bar 20 to allow the pull cord to be easily grasped. Alternately other means for anchoring the end of the pull cord 25 can be employed, such as a conventional tie-down cleat.

The super stretcher bar 20 is attached in a substantially vertical orientation to the upper end of the standard 40 by means of a number of sliding clamps 30. These clamps 30 are shown in greater detail in the exploded view of FIG. 6. Each clamp 30 has an opening with substantially the same cross-sectional dimensions as the upper end of the standard 40. This allows the clamps 30 and super stretcher bar 20 to slide up or down with respect to the standard 40 to adjust the height of the net 10 before tension is applied to the net cables 12 and 14. After the net has been adjusted to the desired height, tension is applied to the net cables 12 and 14 by means of the compound pulley arrangement, as previously discussed. A bending moment is created in the super stretcher bar 20 and the clamps 30 by tensioning the net cables. This tends to bow the super stretcher bar 20 and slightly warps the alignment of the clamps 30 with respect to the standard, thereby preventing movement between the clamps and the standard. Sliding motion between the clamps and the standard can be restored at any time by releasing the tension on the net cables.

Figure 6:
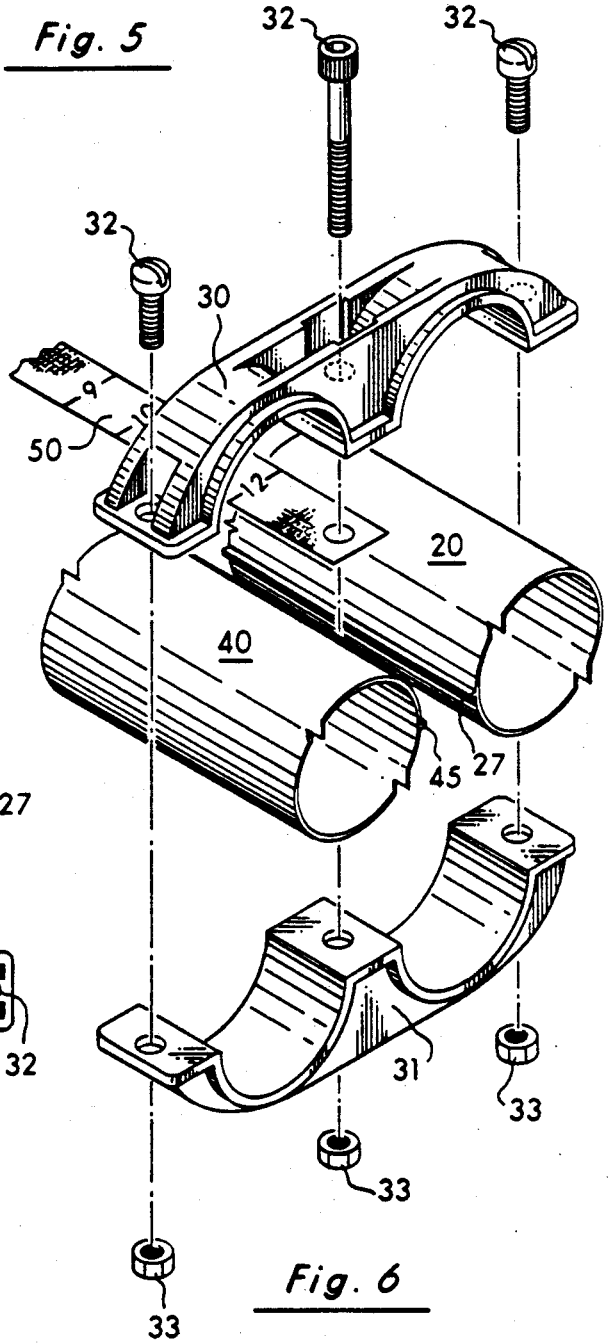
FIG. 6 is an exploded perspective view L corresponding to FIG. 5 showing the manner in which the height of the volleyball net can be adjusted.

As shown in FIG. 6, each clamp 20 is formed of two halves. A series of bolts 32 and nuts 33 are employed to secure the halves of the clamp together. Two small ridges 27 and 45 extend lengthwise along the standard 40 and super stretcher bar 20, respectively, between the halves of the clamps 30 to prevent unwanted axial rotation of the standard 40 or the super stretcher bar 20.

Figure 5:
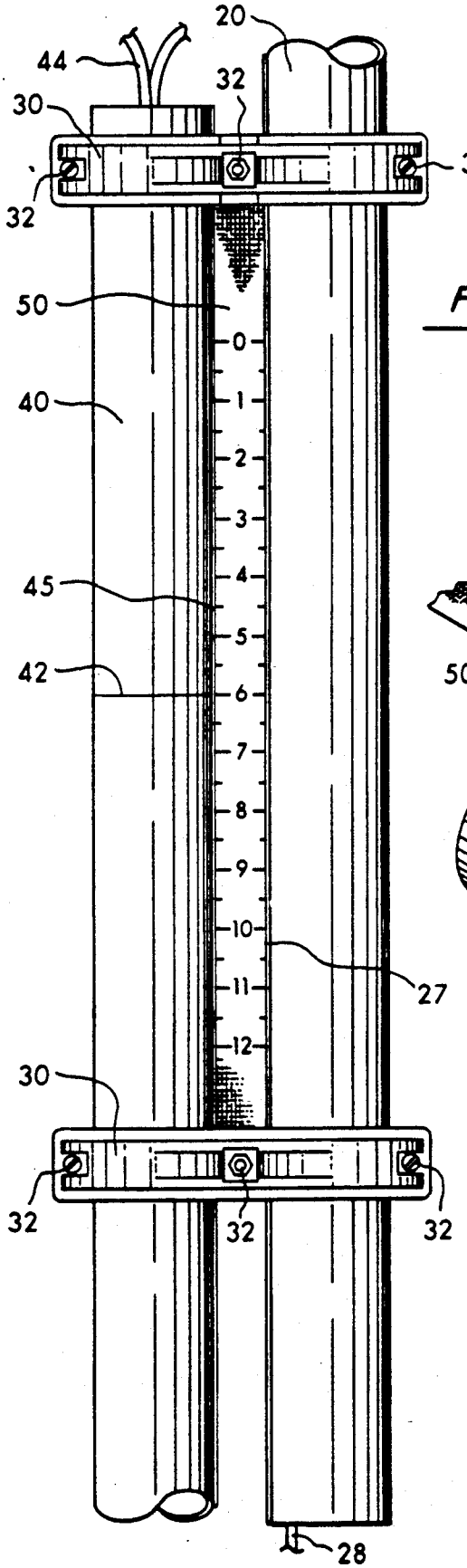
FIG. 5 is a front view of the super stretcher bar and a portion of the standard showing the scale used to indicate the height of the volleyball net.

In the preferred embodiment of the present invention, a scale or ruler 50 extends between two clamps 30 adjacent to the standard. The scale 50 is calibrated in inches (and/or centimeters) along its length as shown in FIG. 5. At least one reference mark 42 located near eye-height on the standard next to the scale 50 provides a point of measurement for reading the height of the net 10. A series of reference marks 42 can be spaced at intervals of one foot along the length of the standard 40. For example, reference marks 42 corresponding to net heights of seven and eight feet, respectively, are commonly used for volleyball nets. The scale 50 then provides a convenient means for more accurately adjusting and measuring net heights to within a fraction of an inch.

The structure of the other end of the net assembly can be substantially the same as that shown in the drawings. However, there is no need for a second tensioning assembly. This means that the upper and lower net cables can be directly fastened to the super stretcher bar at the opposite end of the net, and the guide wheels, compound pulley arrangement, and cleat can be omitted at that end.

The preceding discussion and the drawings have focussed on the invention as applied to a volleyball net assembly. It should be understood that the present invention is not limited to volleyball nets, and could be readily adapted to other types of sports nets, such as badminton nets, tennis nets and the like.

The above disclosure sets forth a number of embodiments of the present invention. Other arrangements or embodiments, not precisely set forth, could be practiced under the teachings of the present invention and as set forth in the following claims.

I claim:

1. A tensioning and support system for a sports net assembly comprising:

two supports spaced a predetermined distance apart;

a net suspended between said supports with at least a first lateral edge having an upper cable and a lower cable extending from said lateral edge toward a first one of said supports;

upper directing means attached to said first support for directing said upper cable downward along said support;

lower directing means attached to said first support for directing said lower cable upward along said support;

a compound pulley arrangement having:

(a) an upper pulley attached to said upper cable and having at least one sheave;

(b) a lower pulley attached to said lower cable and having at least one sheave; and (c) a pull cord routed about the sheaves of said upper pulley and said lower pulley with a free end portion, such that a tensile force exerted on said free end portion of said pull cord adjusts the relative positions of said upper pulley and said lower pulley and thereby adjusts the tension placed on said upper cable and said lower cable; and anchoring means for adjustably securing said free end portion of said pull cord with respect to said first support.

2. The system of claim 1, wherein said supports each comprise:

a standard having a lower end secured to the ground and an upper portion;

an upper elongated member; and clamping means for adjustably securing said upper elongated member to said upper portion of said standard;

said net being suspended between said upper elongated members of said supports, with at least one of said upper elongated members also supporting said compound pulley arrangement.

3. The system of claim 2, wherein said supports each further comprise a scale adjacent to said standard and said upper elongated member calibrated to show the height of said net.

4. The system of claim 1, wherein said first support comprises:

a standard having a lower end secured to the ground and an upper portion;

a tubular member housing said compound pulley arrangement and suspending one end of said net; and clamping means for adjustably securing said tubular member to said upper portion of said standard to provide height adjustment for said net.

5. The system of claim wherein said anchoring means comprises a clam cleat.

6. The system of claim 1 wherein said anchoring means comprises a one-way clamping means allowing said free end portion of said pull cord to be drawn through said clamping means in a direction tending to tighten said upper cable and said lower cable, and tightly gripping said pull cord when said tensile force is released to prevent retraction of said pull cord through said clamping means.

7. A tensioning and support system for a sports net assembly comprising:

a pair of supports, each support having:

(a) a standard having a lower end secured to the ground and an upper portion; and (b) an upper elongated member; and (c) clamping means for adjustably securing said upper elongated member to said upper portion of said standard to allow adjustment of the height of said upper elongated member;

a net having two lateral edges, with a first lateral edge having an upper cable and a lower cable extending therefrom, and a second lateral edge suspended from a second one of said upper elongated members;

upper directing means attached to a first one of said upper elongated members for directing said upper cable downward along said first elongated member;

lower directing means attached to said first elongated member for directing said lower cable upward along said first elongated member;

a compound pulley arrangement having:

(a) an upper pulley attached to said upper cable and having at least one sheave;

(b) a lower pulley attached to said lower cable and having at least one sheave; and (c) a pull cord routed about the sheaves of said upper pulley and said lower pulley with a free end portion, such that a tensile force exerted on said free end portion of said pull cord adjusts the relative positions of said upper pulley and said lower pulley and thereby adjusts the tension placed on said upper cable and said lower cable; and anchoring means for adjustably securing said free end portion of said pull cord with respect to said first elongated member.

8. The system of claim 7, wherein said first elongated member comprises a tubular section housing said compound pulley arrangement.

9. The system of claim 7, wherein at least one of said supports further comprises a scale adjacent to said standard and said upper elongated member calibrated to show the height of said net.

10. The system of claim 7, wherein said anchoring means comprises a clam cleat.

11. The system of claim 7, wherein said anchoring means comprises a one-way clamping means allowing said free end portion of said pull cord to be drawn through said clamping means in a direction tending to tighten said upper cable and said lower cable, and tightly gripping said pull cord when said tensile force is released to prevent retraction of said pull cord through said clamping means.

12. The system of claim 7, wherein said first elongated member comprises a tubular section housing said anchoring means.

13. A tensioning and support system for a sports net assembly comprising:

a pair of supports, each support having a substantially vertical standard with a lower end secured to the ground at a predetermined distance apart from one another, and an upper portion;

a net having two lateral edges, with a first lateral edge having an upper cable and a lower cable extending therefrom;

an elongated tubular member having an interior void;

clamping means for adjustably securing said tubular member to said upper portion of said first standard;

upper directing means attached to said tubular member for directing said upper cable downward along the interior of said tubular member;

lower directing means attached to said tubular member for directing said lower cable upward along the interior of said tubular member;

a compound pulley arrangement housed within said tubular member having:

(a) an upper pulley attached to said upper cable and having at least one sheave;

(b) a lower pulley attached to said lower cable and having at least one sheave; and (c) a pull cord routed about the sheaves of said upper pulley and said lower pulley with a free end portion, such that a tensile force exerted on said free end portion of said pull cord adjusts the relative positions of said upper pulley and said lower pulley and thereby adjusts the tension placed on said upper cable and said lower cable;

anchoring means for adjustably securing said free end portion of said pull cord with respect to said tubular member;

a second elongated member; and clamping means for adjustably securing said second elongated member to said upper portion of said second standard.

14. The system of claim 13, wherein at least one of said supports further comprises a scale calibrated to show the height of said net.

15. The system of claim 13, wherein said anchoring means comprises a clam cleat.

16. The system of claim 13, wherein said anchoring means comprises a one-way clamping means allowing said free end portion of said pull cord to be drawn through said clamping means in a direction tending to tighten said upper cable and said lower cable, and tightly gripping said pull cord when said tensile force is released to prevent retraction of said pull cord through said clamping means.

17. The system of claim 13, wherein said anchoring means is housed within said tubular member.

* * * * *